US010494944B2

(12) United States Patent
Humhauser

(10) Patent No.: US 10,494,944 B2
(45) Date of Patent: Dec. 3, 2019

(54) SEAL ON THE INNER RING OF A GUIDE VANE

(71) Applicant: MTU Aero Engines AG, Munich (DE)

(72) Inventor: Werner Humhauser, Moosburg (DE)

(73) Assignee: MTU Aero Engines AG, Munich (DE)

( * ) Notice: Subject to any disclaimer, the term of this patent is extended or adjusted under 35 U.S.C. 154(b) by 33 days.

(21) Appl. No.: 15/933,410

(22) Filed: Mar. 23, 2018

(65) Prior Publication Data

US 2018/0274380 A1 Sep. 27, 2018

(30) Foreign Application Priority Data

Mar. 23, 2017 (EP) ..... 17162630

(51) Int. Cl.
*F01D 11/00* (2006.01)
*F01D 9/04* (2006.01)

(52) U.S. Cl.
CPC ..... *F01D 11/005* (2013.01); *F01D 9/041* (2013.01); *F01D 9/042* (2013.01); *F05D 2220/32* (2013.01); *F05D 2230/60* (2013.01); *F05D 2240/12* (2013.01); *F05D 2240/50* (2013.01); *F05D 2240/55* (2013.01)

(58) Field of Classification Search
CPC ..... F01D 11/005; F01D 9/041; F01D 9/042; F01D 17/162
See application file for complete search history.

(56) References Cited

U.S. PATENT DOCUMENTS 2,869,821 A * 1/1959 Halford ..... F01D 5/187 415/139
4,395,195 A * 7/1983 De Cosmo ..... F01D 9/042 415/137
2003/0170115 A1* 9/2003 Bowen ..... F01D 9/02 415/160
2018/0112555 A1* 4/2018 Humhauser ..... F01D 9/041

FOREIGN PATENT DOCUMENTS

EP 2696041 A1 2/2014
EP 2725200 A1 4/2014
EP 2725200 A1 * 4/2014 ..... F01D 9/042

OTHER PUBLICATIONS

EP 2725200, Machine translation, Apr. 2014.*

* cited by examiner

*Primary Examiner* — Woody A Lee, Jr.
(74) *Attorney, Agent, or Firm* — Barlow, Josephs & Holmes, Ltd.

(57) ABSTRACT

A guide vane assembly according to the invention comprises an inner ring, on whose radially outer surface an uptake channel runs in the peripheral direction; a plurality of bearing members, which are arranged in the uptake channel of the inner ring; a plurality of guide vanes, each of which is inserted by its radially inner end into one of the bearing members; and at least one sealing element for sealing at least one gap between the inner ring and at least one of the bearing members and/or between two bearing members. A turbomachine according to the invention comprises a guide vane assembly according to the invention. A method according to the invention serves for the installation of a guide vane assembly.

17 Claims, 1 Drawing Sheet

SEAL ON THE INNER RING OF A GUIDE VANE

BACKGROUND OF THE INVENTION

Figure 1:
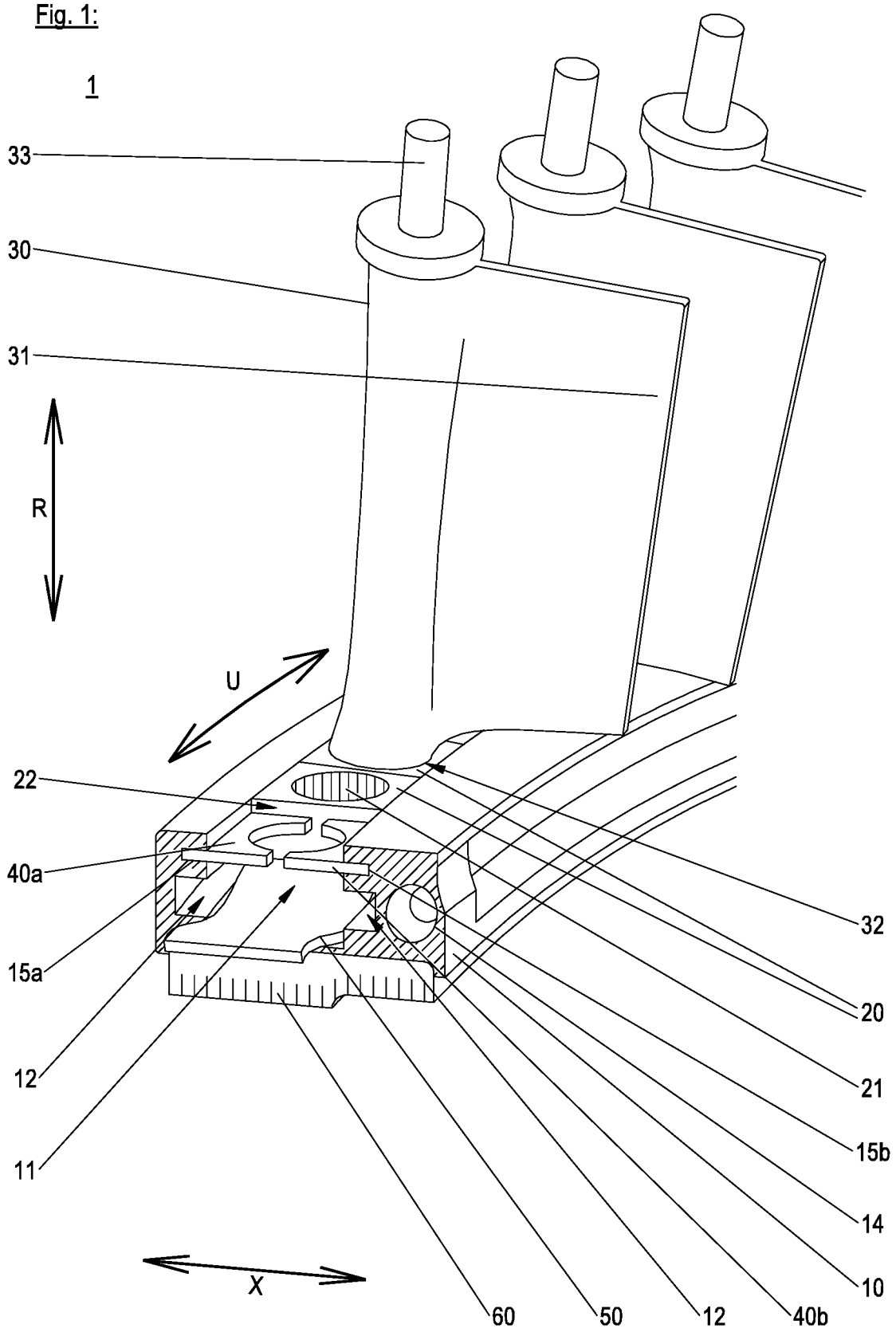

The present invention relates to a guide vane assembly for a turbomachine, a turbomachine, and a method for installing a guide vane assembly.

Turbomachines such as aircraft engines and stationary gas turbines often have at least one guide vane assembly for the adjustment of optimal operating conditions. This ring comprises an inner ring and a plurality of guide vanes, one end of which is arranged on the inner ring, and these guide vanes extend radially outward, starting from this point; the terms "radial", "axial" and "in the peripheral direction" in this document always pertain—unless otherwise indicated—to a central geometrical axis of the guide vane assembly or the inner ring, which is not always additionally stipulated for better readability. Insofar as the respective indications pertain to individual parts of the guide vane assembly, they are to be understood in relation to the designated orientation of the respective individual part in the guide vane assembly.

A guide vane assembly may have an adjustable design, in particular; in this case, the guide vanes are able to swivel about a designated swivel axis, which generally corresponds to a lengthwise axis of the guide vanes and runs substantially radially. The swiveling may occur by way of external adjustment components on the guide vanes, especially by means of adjusting pins, which are inserted or can be inserted into corresponding uptakes of the casing and which then can interact with a corresponding adjustment device on the external casing.

An internal stabilization of the guide vanes in known guide vane assemblies is often carried out by way of bearing pins, which extend radially inward from a respective guide vane plate and which may be introduced into bearing bushes of the inner ring.

In EP 2 696 041 A1, an adjustable guide vane assembly is proposed, in which the guide vanes are mounted each time in bearing members having a block-like basic shape and a bearing bore. In this case, the inner ring is composed of two half-rings, which are shoved onto the bearing member in the peripheral direction. Such a guide vane assembly affords the advantages of an easy assembly, in particular.

However, due to manufacturing tolerances or vibrations, recirculation of air may occur through gaps at the edge surfaces of the bearing members. This reduces the efficiency of the turbomachine.

SUMMARY OF THE INVENTION

The object of the present invention is to provide a technique by which the prevention of leakage can be further improved while still maintaining a simple assembly.

The object is achieved by a guide vane assembly for a turbomachine, by a turbomachine and by a method for installing a guide vane assembly according to the present invention. Advantageous embodiments are discussed in detail below.

A guide vane assembly for a turbomachine according to the invention comprises an inner ring with an uptake channel running in the peripheral direction on its radially outer surface, as well as a plurality of guide vanes and a plurality of bearing members, which are arranged in the uptake channel of the inner ring. In this case, a radially inner end (for example, a bearing element, such as a bearing pin, in particular) of the guide vanes is inserted into each of the bearing members (e.g., into a bore situated therein). Furthermore, the guide vane assembly comprises at least one sealing element for sealing at least one gap between the inner ring and at least one of the bearing members and/or between two bearing members.

A turbomachine according to the invention comprises a guide vane assembly according to the invention in accordance with one of the embodiments disclosed in this document.

A method according to the invention serves for the mounting of a guide vane assembly (especially a guide vane assembly according to the invention in accordance with one of the embodiments disclosed in this document). It involves the threading of a plurality of bearing members into the uptake channel of an inner ring segment of the guide vane assembly. Each time, a radially inner end of one of a plurality of guide vanes of the guide vane assembly is inserted into the bearing members. A gap between a side wall of the uptake channel and at least one of the bearing member and/or between two bearing members is sealed by at least one sealing element. The method can furthermore involve (prior to the threading of the bearing members) the inserting of the respective radially inner ends of the guide vanes into the bearing members (or bores arranged therein). Preferably, at their radially outer ends, the guide vanes are inserted into respective mounts on the casing side (e.g., with a respective adjusting pin) during the threading of the bearing members.

A guide vane assembly according to the invention, a turbomachine according to the invention, and a method according to the invention enable a sealing of gaps at the inner ring and thus a clear reduction of leakage. In particular, a recirculation of air can be prevented, thus bringing about a greater efficiency of the turbomachine. As a result of the additional friction at the sealing element, this sealing element furthermore has a stabilizing effect on the arrangement made up of inner ring and bearing members.

The radially inner ends of the guide vanes may be inserted or will be inserted into their own associated bearing members and/or the guide vane assembly may comprise guide vanes whose radially inner ends are or will be inserted into a common bearing member (e.g., two, three or more guide vanes at a time). In particular, the guide vane assembly may comprise just as many bearing members as there are guide vanes or fewer bearing members than there are guide vanes.

The guide vane assembly may be provided, in particular, for a compressor stage of the turbomachine.

The at least one sealing element is preferably composed, at least in part, of sheet metal. This can assure a good durability.

Preferably, the at least one sealing element is arranged, at least partly, in a respective gap, which it seals off and narrows, and/or bridges over.

According to one advantageous embodiment of the present invention, the uptake channel has at least one groove at a side wall, in which a section of the at least one sealing element is or will be inserted (especially drawn in), or the uptake channel has at least one groove on each of two mutually facing side walls, in which a section of the sealing element (which is then inserted in both grooves as a sealing element) or a respective corresponding sealing element is or will be inserted.

Similarly (alternatively or additionally), at least one of the bearing members may have at least one groove, in which a portion (i.e., a section) of the at least one sealing element is or will be inserted.

Such a sealing element inserted into one or a plurality of grooves is anchored particularly firmly, so that it remains fixed in place despite the vibrations occurring during the operation of the turbomachine, and produces an especially high efficiency of the seal.

On a side located opposite the section or portion inserted into a respective groove, the sealing element may protrude freely into the gap, or it may abut against and/or bend around a surface of the respective bearing member or against a side wall of the uptake channel.

Alternatively, the sealing element may be inserted into a respective groove on both sides (for example, it can be drawn in): especially advantageous is a variant of the present invention in which a gap is bridged over between a side wall of the uptake channel and at least one bearing member by the at least one sealing element. For example, both the side wall of the uptake channel and also at least one of the bearing members may each have a groove, and the at least one sealing element may be inserted or will be inserted (like a tongue and groove connection) at one side into the groove of the side wall of the uptake channel and at an opposite side into the groove of the at least one bearing member.

A preferred variant embodiment of a method according to the invention involves the inserting of the at least one sealing element into a groove situated in at least one bearing member before the bearing member is threaded into the uptake channel. During the threading process, the sealing element may be drawn into a groove preferably present in a side wall of the uptake channel or be butted against or bent around the side wall.

According to one preferred embodiment of the present invention, at least two bearing members arranged in succession in the peripheral direction may each have a groove at their contact surfaces, in which a common sealing element is inserted or will be inserted on opposite sides (similar to a tongue and groove connection). Thus, the sealing element can bridge a gap between the bearing members along the entire lengthwise extent of the gap, or partially, for example, for at least half of the lengthwise extent or at least a third of the lengthwise extent of the gap.

The bearing members may preferably each have a substantially block-shaped basic form with a bore for a respective radially inner end of a guide vane; furthermore, a profile may be formed on or in the basic form, for example, in the shape of at least one region which is enlarged and/or narrowed (especially in the axial direction), for example, at least one step, at least one crosspiece, and/or—as mentioned above—at least one groove, by means of which the bearing members can be or will be joined (for example, in a form fit) to one another, to the sealing element, and/or to the inner ring. For example, the bearing members may be composed of carbon, at least partly. They may be formed metal-free or comprise a coated metal.

According to one advantageous embodiment of the present invention, the at least one sealing element in a groove of the at least one bearing member encircles a bore, at least partly, in which the radially inner end of a guide vane is inserted. With respect to a central axis of the bore or a lengthwise axis of the guide vane, each sealing element may subtend or enclose, for example, a center axis angle of at least 90°, at least 120° or even at least 150°.

In particular, the sealing element may have, for example, a substantially arc-shaped section with such a center axis angle. This makes possible, on the one hand, an easily fabricated and solid configuration of the sealing element, such that it may proceed from a side wall of the uptake channel and extend particularly far into a gap between two bearing members arranged in succession in the peripheral direction, so that an especially effective seal is achieved. On the other hand, the arc shape prevents the bearing member and sealing element from shifting relative to each other in the peripheral direction.

The at least one sealing element may be composed of a plurality of individual elements, which are or can be arranged in succession in the peripheral direction. In particular, the plurality of individual elements may correspond to the number of bearing members or be a multiple of this number (preferably a whole number). The plurality of individual elements may be or will be joined together by the bearing members, for example, in that each individual element is or will be inserted into grooves of at least two bearing members (arranged successively in the peripheral direction).

According to one preferred embodiment, the at least one sealing element is formed as a cohesive (preferably formed as a single piece or monolithically) partial ring, for example, as a ring sector (divided in the peripheral direction). In this case, it may subtend a center axis angle of the inner ring of at least 90°, at least 120° or at least 180°, thus at least a quarter, at least a third, or at least half of the center axis of the inner ring. Particularly advantageous is an embodiment with two sealing elements formed as such partial rings, which are or will be arranged at mutually opposite walls of the uptake channel.

The inner ring may have at least one damping element, which can be or will be arranged in the uptake channel between the inner ring and the plurality of bearing members. The damping element may be designed, for example, as a spring element, and/or devised to press the bearing members and the inner ring against each other in one section. In this way, a vibration-resistant fixation of the at least one sealing element may also be improved. Such a damping element can be formed at least in part from metal and/or have a wavy or corrugated structure; the waves (or their wave fronts) of such a structure may run, for example, axially or in the peripheral direction.

BRIEF DESCRIPTION OF THE DRAWING FIGURES

In the following, preferred exemplary embodiments of the invention shall be explained more closely on the basis of a drawing. It is understood that individual elements and components are optional and/or can be combined in a manner other than the one which is shown.

Shown schematically herein:

FIG. 1 shows part of an exemplary guide vane assembly according to the invention in perspective representation.

DESCRIPTION OF THE INVENTION

FIG. 1 shows a portion of an adjustable guide vane assembly 1 according to one embodiment of the present invention; for a better understanding of the layout, individual elements are omitted here, regardless of an advantageous sequence of installation steps.

The guide vane assembly 1 comprises an inner ring 10, which is or will be composed of a plurality of inner ring segments (e.g., two); in the FIGURE, only one portion of the inner ring 10 is shown, namely, one end of an inner ring segment, having a bore 14 for the connection (by means of a pin led through it, which is not shown) to one end of another ring segment, which is not shown. The inner ring segment has an entry opening at the end shown into an uptake channel 11 for bearing members 20 that extends in the peripheral direction U; during the installation, the bearing members can be threaded one after the other through this entry opening and onto the inner ring segment (and thus onto the inner ring). In the exemplary embodiment shown in the FIGURE, several bearing members are already threaded into the uptake channel.

The guide vane assembly 1 furthermore comprises a plurality of guide vanes 30, each of which is inserted by its radially inner end 32 (preferably comprising a bearing element such as a bearing pin, for example) into a corresponding bearing member 20 (i.e., into a bore 21 situated therein). The respective radially inner end of the guide vanes and/or a surface of the bearing member in the bore may be coated to reduce friction and/or wear. In the FIGURE, the most forward bearing member 20 is shown not yet assembled for reasons of clarity, i.e., without an inserted end of a guide vane.

The guide vanes each have a vane element 31 and can be swiveled by way of an adjusting pin 33, which is designed to be inserted into corresponding uptakes of a casing (not shown).

The bearing member 20 and inner ring 10 are joined together in a form fit in the exemplary embodiment shown in the FIGURE, both in the axial direction X and in the radial direction R in the present case. For this purpose, the uptake channel 11 has a region 12 enlarged in the axial direction X, in which a corresponding protrusion (not visible in the FIGURE) of the bearing member 20 is inserted.

The guide vane assembly 1 represented in the FIGURE furthermore comprises sealing elements 40*a*, 40*b*, which are inserted opposite each other in respective grooves 15*a*, 15*b* in the side wall of the uptake channel 11. For clarity, a corresponding bearing member, in which the sealing elements 40*a*, 40*b* visible in the FIGURE are intended to engage, is not shown. Such a bearing member has grooves on its sides facing the side walls of the uptake channel 11, which are designed to receive the sealing elements 40*a*, 40*b*. The latter then each bridge over a gap between the walls of the uptake channel 11 and the bearing member, in the present case along the entire lengthwise extent of the respective gap.

Preferably, the sealing elements 40*a*, 40*b* are each formed as sectors of a ring (e.g., half-rings), which partly encircle the central axis of the inner ring 10 along the uptake channel and in this case are continued (which is not visible in the FIGURE) in corresponding grooves of the bearing members 20 shown, arranged in succession in the peripheral direction U. The sealing elements 40*a*, 40*b* thus engage in grooves of neighboring bearing members at their contact surfaces (especially at the contact surface 22 of the most forward bearing member in the FIGURE) and thereby also bridge over a gap between bearing members arranged in succession in the peripheral direction. In the example shown, the sealing elements 40*a*, 40*b* together then bridge over more than 80% of the lengthwise extent of this gap.

In the FIGURE, for better clarity, the sealing elements 40*a*, 40*b* are shown as flush with the end of the inner ring segment finally shown. According to one advantageous embodiment (not represented), the sealing elements protrude beyond a connection of inner ring segments, and thus bridge over this connection. Alternatively or additionally, a bearing member may be arranged so that it bridges over the mentioned connection (which is likewise not shown in the FIGURE) by being partly inserted in the uptake channel of a first inner ring segment and partly in the uptake channel of a second inner ring segment. In this way, leakage at the connection of the inner ring segments can be reduced in each case.

The sealing elements 40*a*, 40*b* each have an arc-shaped section which is designed to partly encircle a bore 21 arranged in a corresponding groove of a bearing member 20, in which the radially inner end of a respective guide vane is inserted; in the example shown, each of the sealing elements 40*a*, 40*b* subtends a center axis angle of more than 120° about a lengthwise axis of the respective guide vane. In this way—despite the bore which is present—an especially deep engagement of the sealing element in the respective bearing member 20 can be realized. Furthermore, the arc shape prevents the bearing member and sealing element from shifting relative to each other in the peripheral direction.

The guide vane assembly 1 furthermore comprises a damping element 50, which is disposed on a (radially inward situated) bottom of the uptake channel 11 between the inner ring 10 and the bearing members 20. According to one advantageous exemplary embodiment, the damping element 50 is designed to bridge over a connection of the inner ring segment to another inner ring segment, so that it may also serve as a damping element in the other inner ring segment.

The damping element 50, for example, may be designed as a spring element (e.g., made of sheet metal), whose spring force presses the bearing members 20 outward in the radial direction R.

In the example shown, the damping element is fashioned as a strip, having a wavy structure, whose wave fronts run in the axial direction X.

By means of the damping element 50, relative movements between inner ring 10 and guide vanes 30 can be damped.

Furthermore, the guide vane assembly 1 in the exemplary embodiment shown has a seal 60 (in the present instance, designed as an inlet lining) to close off a radial gap between inner ring and an oppositely situated rotor section (not shown). The inner ring 10 works here as a seal support.

A guide vane assembly 1 according to the invention comprises an inner ring 10, on whose radially outer surface an uptake channel 11 extends in the peripheral direction U, a plurality of bearing members 20, which are arranged in the uptake channel of the inner ring, a plurality of guide vanes 30, each of which are inserted by their radially inner end 32 into one of the bearing members, and at least one sealing element 40*a*, 40*b* to seal off at least one gap between the inner ring 10 and at least one of the bearing members and/or between two bearing members.

A turbomachine according to the invention comprises a guide vane assembly 1 according to the invention. A method according to the invention serves for the installation of a guide vane assembly 1.

What is claimed is:

1. A guide vane assembly for a turbomachine, comprising:

an inner ring, on whose radially outer surface an uptake channel runs in the peripheral direction;

a plurality of bearing members, which are arranged in the uptake channel of the inner ring;

a plurality of guide vanes, each of which is inserted by its radially inner end into one of the bearing members; and at least one sealing element for sealing at least one gap between the inner ring and at least one of the bearing members and/or between two bearing members, wherein the uptake channel has at least one groove at two mutually facing side walls, into which a respective section of the at least one sealing element is inserted.

2. A guide vane assembly for a turbomachine, comprising:

an inner ring, on whose radially outer surface an uptake channel runs in the peripheral direction;

a plurality of bearing members, which are arranged in the uptake channel of the inner ring;

a plurality of guide vanes, each of which is inserted by its radially inner end into one of the bearing members; and at least one sealing element for sealing at least one gap between the inner ring and at least one of the bearing members and/or between two bearing members, wherein at least one of the bearing members has a groove into which a portion of the at least one sealing element is inserted, and wherein the at least one sealing element in the groove of the at least one bearing member partly encircles a bore of the bearing member, into which the radially inner end of a guide vane is inserted.

3. The guide vane assembly as claimed in claim 1, wherein at least one of the bearing members has a groove into which a portion of the at least one sealing element is inserted.

4. The guide vane assembly as claimed in claim 3, wherein the at least one sealing element in the groove of the at least one bearing member partly encircles a bore of the bearing member, into which the radially inner end of a guide vane is inserted.

5. The guide vane assembly as claimed in claim 1, wherein the at least one sealing element bridges over at least one gap between two bearing members.

6. The guide vane assembly as claimed in claim 1, wherein the at least one sealing element is at least partly composed of sheet metal.

7. The guide vane assembly as claimed in claim 1, wherein the at least one sealing element is formed as a cohesive partial ring, subtending a center axis angle of at least 90°.

8. The guide vane assembly as claimed in claim 1, wherein the at least one sealing element is composed of a plurality of individual elements, arranged in succession in the peripheral direction.

9. The guide vane assembly as claimed in claim 1, wherein the guide vane assembly is configured and arranged in a turbomachine.

10. A method for the mounting of a guide vane assembly, comprising the steps of:

a threading of a plurality of bearing members, into each of which is inserted a radially inner end of a guide vane, into an uptake channel of an inner ring segment of the guide vane assembly, and inserting at least one sealing element into a groove in the at least one bearing member before it is threaded into the uptake channel, wherein a gap between a side wall of the uptake channel and at least one of the bearing members and/or between two bearing members arranged in succession in the peripheral direction is sealed by the at least one sealing element.

11. The method as claimed in claim 10, wherein the at least one sealing element is drawn into a groove in a side wall of the uptake channel.

12. The guide vane assembly as claimed in claim 2, wherein the uptake channel has a groove at one side wall, into which a section of the at least one sealing element is inserted.

13. The guide vane assembly as claimed in claim 2, wherein the at least one sealing element bridges over at least one gap between two bearing members.

14. The guide vane assembly as claimed in claim 2, wherein the at least one sealing element is at least partly composed of sheet metal.

15. The guide vane assembly as claimed in claim 2, wherein the at least one sealing element is formed as a cohesive partial ring, subtending a center axis angle of at least 90°.

16. The guide vane assembly as claimed in claim 2, wherein the at least one sealing element is composed of a plurality of individual elements, arranged in succession in the peripheral direction.

17. The guide vane assembly as claimed in claim 2, wherein the guide vane assembly is configured and arranged in a turbomachine.

* * * * *